US005218337A

United States Patent [19]

Peter

[11] Patent Number: 5,218,337

[45] Date of Patent: Jun. 8, 1993

[54] AUTOMOTIVE VEHICLE TONE GENERATOR

[75] Inventor: Walter H. Peter, Hobart, N.Y.

[73] Assignee: Atoma International Inc., Newmarket, Canada

[21] Appl. No.: 833,005

[22] Filed: Feb. 10, 1992

[51] Int. Cl.[5] ..... G08B 3/00

[52] U.S. Cl. ..... 340/388; 340/384 R; 381/188; 381/205; 116/142 R; 181/159; 181/148

[58] Field of Search ..... 340/388, 384 E, 384 R, 340/391, 404, 392; 381/188, 205, 192, 193, 194, 195, 196, 197, 198, 199, 200, 201; 116/142 R; 181/159, 160, 150, 171, 148, 157, 172, 179

[56] References Cited

U.S. PATENT DOCUMENTS

| | | | |
|---|---|---|---|
| 4,183,278 | 1/1980 | Rea et al. . | |
| 4,267,552 | 5/1981 | Frigo | 340/388 |
| 4,286,257 | 8/1981 | Slavin et al. . | |
| 4,410,881 | 10/1983 | Seyler | 340/388 |
| 4,717,906 | 1/1988 | Smith | 340/388 |
| 4,823,110 | 4/1989 | Dorward et al. . | |

*Primary Examiner*—Jin F. Ng
*Assistant Examiner*—Nina Tong
*Attorney, Agent, or Firm*—Cushman, Darby & Cushman

[57] ABSTRACT

A transducer and tone generator embodying the same and method of assembling the transducer components with the use of an assembly fixture. The transducer components include a rigid annular structure, a pole piece, an electromagnetic coil assembly, and a diaphragm. The method of assembly includes the steps of engaging (1) a diaphragm-engaging surface of the rigid annular structure and (2) an end surface of the pole piece with (1) an outer annular fixture surface and (2) a central fixture surface respectively while a pole piece end portion is engaged with a pole piece engaging surface of the rigid annular structure so as to establish a predetermined axial space between the diaphragm-engaging surface and the end surface, securing the pole piece and rigid annular structure together against relative axial movement with respect to one another and the electromagnetic coil assembly in aligned relation thereto within a central space of the rigid annular structure and in surrounding relation to the pole piece, and mounting the diaphragm in assembled relation within the transducer solely by engaging a marginal edge portion thereof with the diaphragm engaging surface to be retained therein solely by the magnetic attraction of a permanent magnet of the rigid annular structure.

25 Claims, 3 Drawing Sheets

AUTOMOTIVE VEHICLE TONE GENERATOR

FIELD OF THE INVENTION

This invention relates to acoustic transducers and more particularly to transducers for automotive vehicle use capable of producing a chime signal or the like.

BACKGROUND OF THE INVENTION

Acoustic transducers of the type herein contemplated are well known in the art. An exemplary device of this type is disclosed in U.S. Pat. No. 4,823,110. As stated in the patent, a particularly acute problem in producing devices of this type is the manner in which the diaphragm is mounted within the device. In general it can be stated that the functional characteristics provided by the diaphragm in the automotive environment are such that it becomes highly desirable to mount the diaphragm in a manner which can be repeated on a mass production basis sufficient to maintain uniformity in operation without significant variation.

The mounting of the diaphragm is critical in this regard in two functional aspects requiring repeatability without significant variation. The first aspect is that the mounting must serve to accurately position the diaphragm with respect to the pole piece. The second aspect is that the mounting must provide a difficult to consistently achieve acoustical seal for the interior chamber which enables dynamic acoustical sealing to occur while permitting static pressure leakage to occur. The manner of securing the diaphragm to the fixed structure may detrimentally effect these two functional aspects. The interrelationship between the various aspects of the diaphragm mounting materially contribute to the difficulty of the problem presented. The chamber which the diaphragm must acoustically seal contains the pole piece spacing. Consequently, the spacing cannot be conveniently determined after the diaphragm is mounted in acoustically sealed relation. Moreover, the physical contact which the diaphragm is subjected to in accomplishing its mount can effect both the pole piece spacing and the acoustic seal of the chamber as well as the vibrational characteristics of the diaphragm itself.

The mounting arrangement of the '110 patent is to utilize a rigid retaining number having spaced lugs which contact the diaphragm at spaced positions along its marginal periphery. This mode of mounting is described in the patent as replacing prior art modes wherein spaced spot weldings are used to secure the diaphragm to its fixed support or a ring of foam rubber is used to resiliently retain the marginal periphery of the diaphragm on its fixed seat. These structural mountings are difficult to repeat uniformly in such a way as to insure that the functional aspects attributable to the diaphragm mount are achieved.

There is still a need for an automotive chime or transducer which more nearly achieves the desired functional aspects of the diaphragm mount in a more uniformly repeatable manner and in a more cost effective manner.

SUMMARY OF THE INVENTION

It is an object of the present invention to fulfill the need identified above. In accordance with the principles of the present invention this objective is obtained by providing a tone generator suitable for automotive vehicle use comprising a housing assembly defining an interior space open to the atmosphere, a circuit board assembly mounted within the housing assembly, and a transducer carried by the circuit board assembly within the housing assembly. The transducer comprises a rigid structure of magnetic material annular about a central axis having an axially outwardly facing annular diaphragm engaging surface formed in one axial end portion thereof, an interior peripheral surface extending axially therefrom defining a central space terminating in a radially inwardly directed opposite end wall having a central pole piece engaging interior axially extending surface therein communicating with said central space. A diaphragm of magnetic material has an outer annular marginal edge portion which is engaged with the diaphragm engaging surface and a central portion providing an armature. The rigid annular structure includes a permanent magnet operable to constantly magnetically attract the marginal edge portion of the diaphragm into engagement with the diaphragm engaging surface of the rigid annular structure. The diaphragm and armature are free of engagement other than the engagement of the outer annular marginal edge portion thereof with the annular diaphragm engaging surface so that the aforesaid magnetic attraction solely provides the function of constantly retaining the diaphragm in an operative position with respect to the rigid annular structure enclosing the associate axial end of the central space. A pole piece is provided which extends within the central space in alignment with the axis. The pole piece is fixedly secured with respect to the rigid structure with an end portion of the pole piece engaged in a predetermined position of axial adjustment along the pole piece engaging surface so that a remote end surface of the pole piece is disposed within the central space a predetermined gap distance from the central portion of the diaphragm. An electromagnetic coil assembly is mounted within the central space in surrounding relation to the pole piece and in axially spaced relation with the diaphragm so as to leave a portion of the central space enclosed by the diaphragm operatively dynamically acoustically sealed by the engagement of the outer marginal peripheral edge portion thereof with the diaphragm engaging surface but statically pressure communicated with the interior space within the housing assembly. The rigid annular structure is mounted on the circuit board assembly and is electrically connected with the circuit board assembly so as to be electrically energized by the operation of the circuit board assembly to thereby impart vibrations to the diaphragm which dynamically varies the conditions within the closed portion of the central space and creates within the interior space within the housing assembly a desired tone sequence which is audible to a person within the atmospheric environment of the automotive vehicle.

Another object of the present invention is the provision of a method of assembling transducer components with the use of an assembly fixture in which the transducer components include a rigid annular structure including a permanent magnet, the rigid annular structure having an axially outwardly facing annular diaphragm engaging surface formed in one axial end portion thereof, an interior peripheral surface extending axially therefrom defining a central space terminating in a radially inwardly directed opposite end wall having a central pole piece engaging interior axially extending surface therein communicating with the central space, a diaphragm of magnetic material having an outer annular marginal edge portion, a pole piece having an end portion engageable with the pole piece engaging surface of the rigid annular structure for axial movement with respect thereto and a remote end surface, and an electromagnetic coil assembly, and the assembly fixture has an outer annular surface shaped to be engaged by the diaphragm engaging surface of the rigid annular structure and a central surface spaced a predetermined axial distance from the outer annular surface shaped to be engaged by the end surface of the pole piece. The method comprises the steps of engaging (1) the diaphragm engaging surface of the rigid annular structure and (2) the end surface of the pole piece with (1) the outer annular surface and (2) central surface respectively of the assembly fixture while the end portion of the pole piece is engaged with the pole piece engaging surface of the rigid annular structure so as to establish the predetermined axial space between the diaphragm engaging surface of the rigid annular structure and the end surface of the pole piece, securing the pole piece and rigid annular structure together against relative axial movement with respect to one another and the electromagnetic coil in aligned relation thereto within the central space of the rigid annular structure and in surrounding relation to the pole piece, and mounting the diaphragm in assembled relation within the transducer solely by engaging the marginal edge portion thereof with the diaphragm engaging surface of the rigid annular structure to be retained therein solely by the magnetic attraction of the permanent magnet of the rigid annular structure.

Another object of the present invention is the provision of an acoustic transducer of the type described which embodies the principles of the present invention as indicated above.

Another object of the present invention is the provision of an acoustic transducer which is simple in construction, effective in operation and economical to manufacture.

These and other objects of the present invention will become more apparent during the course of the following detailed description of the appended claims.

The invention may best be understood with reference to the accompanying drawings wherein an illustrative embodiment is shown.

DETAILED DESCRIPTION OF THE INVENTION

Figure 1:
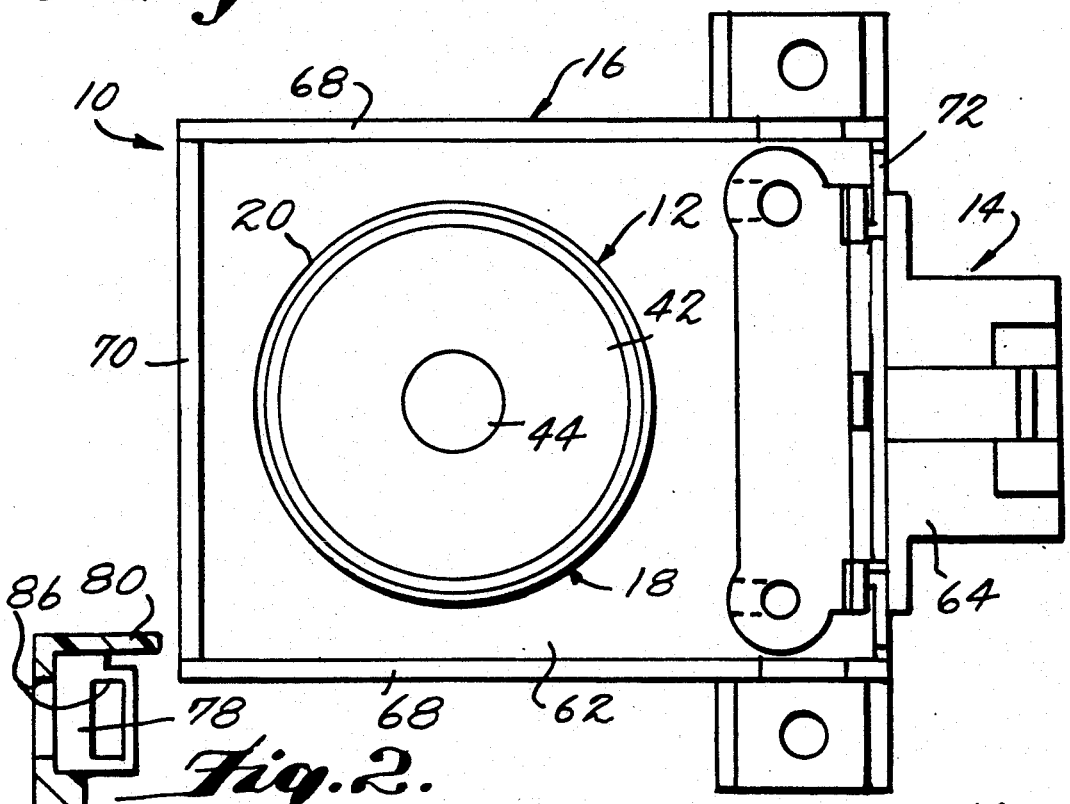
FIG. 1 is a top plan view of a tone generator suitable for automobile vehicle use showing the same with the top removed.
Figure 2:
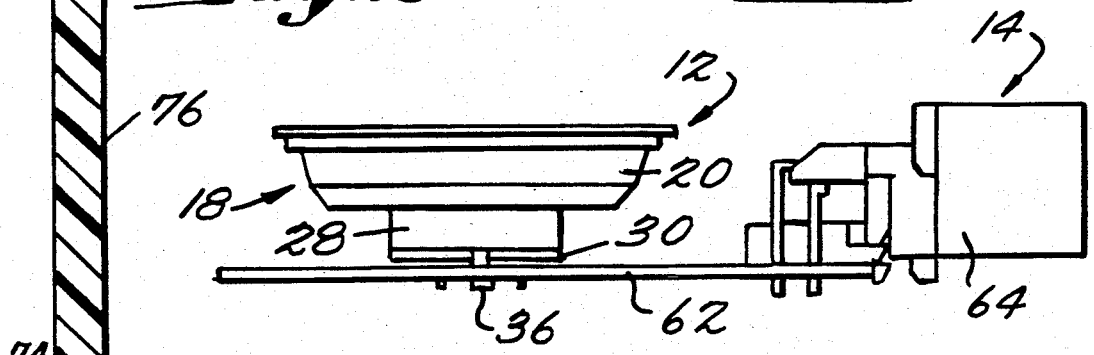
FIG. 2 is a side elevational view showing the acoustic transducer attached to the circuit board assembly.
Figure 3:
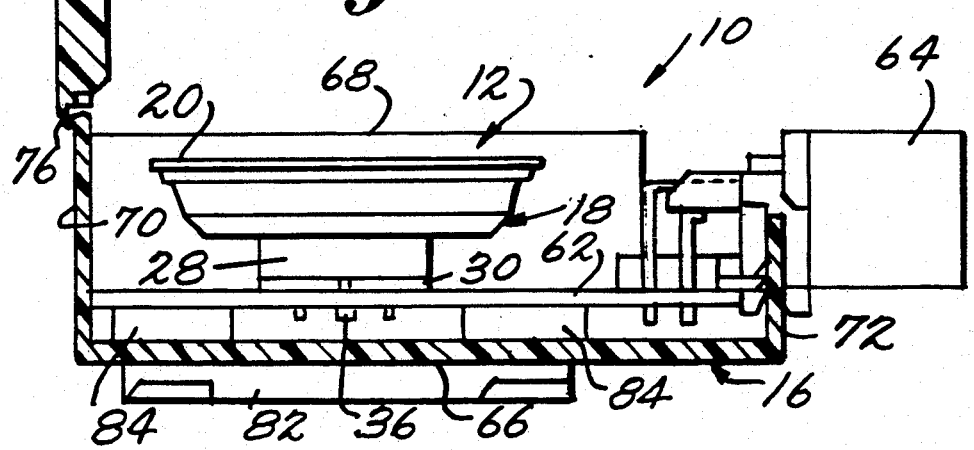
FIG. 3 is a vertical sectional view of the housing assembly with the top open showing the acoustic transducer and the circuit board assembly in side elevation mounted therein.

Referring now more particularly to FIGS. 1 and 3 of the drawings, there is some variant shown therein an automotive vehicle tone generator, generally indicated at 10, which embodies the principles of the present invention. In general, the tone generator 10 comprises an acoustic transducer, generally indicated at 12 which is mounted on a circuit board assembly, generally indicated at 14, both of which are suitably mounted within a housing assembly, generally indicated at 16.

The acoustic transducer 12, which is constructed in accordance with the principles of the present invention, includes a rigid annular structure, generally indicated at 18. The rigid annular structure 18 may be a single molding or casting of a suitable metal capable of being magnetized so that the entire rigid annular structure constitutes a magnet. Alternatively, the construction may include a permanent magnet plus another part or parts. The preferred construction of the rigid annular structure 18 as shown is a three-piece construction which is rigidly interconnected by a suitable adhesive or other such product, a preferred adhesive being epoxy. The three-piece construction includes a sheet metal member 20 which is generally of bowl-like configuration providing an annular diaphragm-engaging surface 22 facing axially outwardly in one direction. An end portion of the sheet metal member 20 extending outwardly of the annular diaphragm-engaging surface 22 is a flanged or generally L-shaped rim configuration.

Axially inwardly of the diaphragm-engaging surface 22 the sheet metal member 20 provides a peripheral wall which merges into a bottom wall having a central aperture 24 formed therein. The bottom wall is recessed, as indicated at 26, in an axial direction toward the rim of the sheet metal member 20 so as to receive therein in a bonded relation one end surface of a ring magnet 28 which constitutes the second piece of the three-piece rigid annular structure 18. An opposite end surface of the ring magnet 28 is bonded to the third piece which is in the form of a base plate or metal end disc 30. The base plate 30 extends inwardly from the ring magnet 28 and provides an opposite end wall within the rigid annular structure 18.

Figure 4:
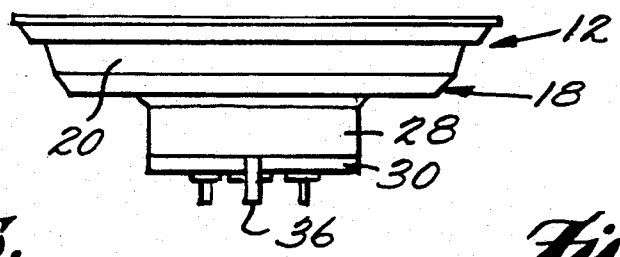
FIG. 4 is a side elevational view of the acoustic transducer shown in FIGS. 2 and 3.
Figure 5:
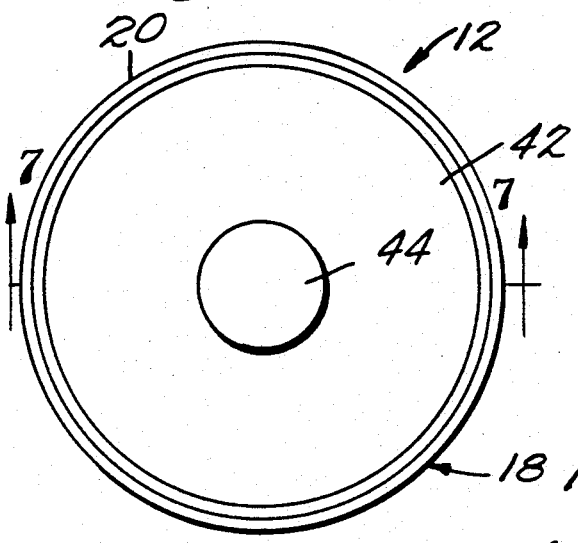
FIG. 5 is a top plan view of the acoustic transducer.
Figure 6:
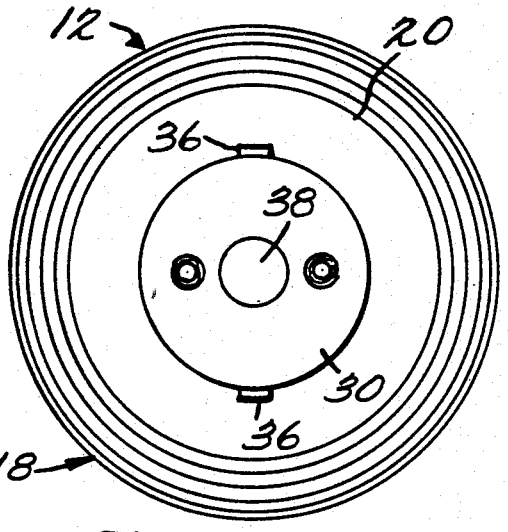
FIG. 6 is a bottom plan view of the acoustic transducer.
Figure 7:
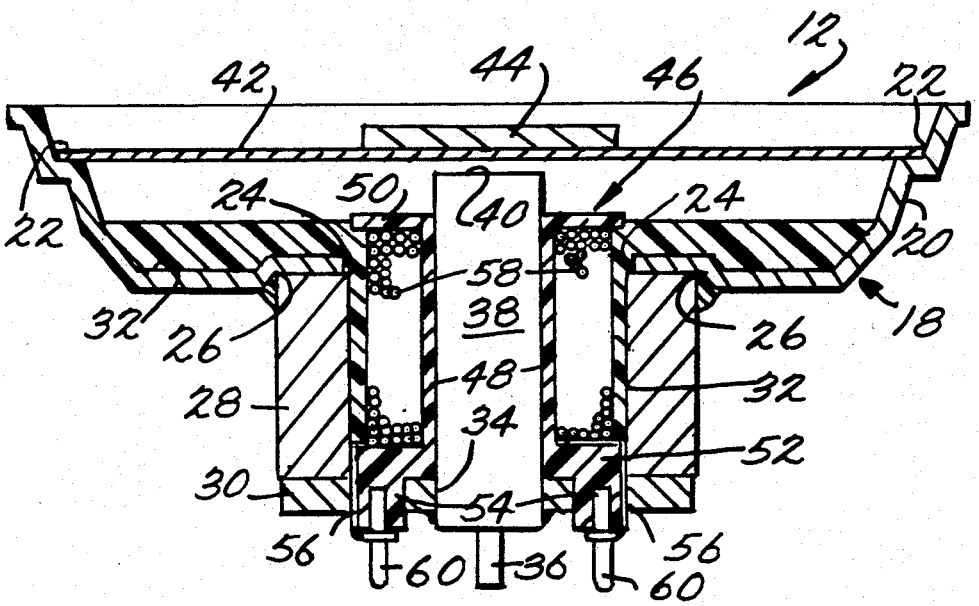
FIG. 7 is an enlarged sectional view taken along the line 7—7 of FIG. 5.

It will be noted that between the base plate 30 and the diaphragm-engaging surface 22, the interior periphery of the sheet metal member 20 and the interior periphery of the ring magnet 28 define a central space 32 which communicates with an axially extending cylindrical pole piece imaging surface 34 formed in the center of the base plate 30. As best shown in FIGS. 4 and 6, the base plate or metal disc 30 includes a pair of identical diametrically opposed integral legs 36 which are bent downwardly so as to extend in depending relation to the base plate 30 so as to serve as mounting legs for the rigid annular structure 18 onto the circuit board assembly 10.

The acoustic transducer 12 also includes a central pole piece 38 which, as shown, is in the form of a cylinder of suitable magnetic material having a cylindrical periphery adapted to register with the pole piece engaging axially extending cylindrical surface 34 in the center of the base plate 30. The pole piece 38 includes an end surface 40 which is adapted to be spaced from the center of a diaphragm 42 of thin metallic material having magnetic characteristics. The diaphragm 40 provides a marginal edge surface which is adapted to engage the diaphragm-engaging surface 22 of the sheet metal member 20. The central portion of the diaphragm constitutes an armature for the pole piece If desired, an augmented armature configuration may be provided by a metal disk 44 suitably bonded to the central exterior of the diaphragm 42.

The acoustic transducer 12 also includes an electromagnetic coil assembly, generally indicated at 46. As shown, the electromagnetic coil assembly includes a bobbin molded of a plastic material having an electrical insulating characteristic. The bobbin is molded to include a cylindrical core 48 having a pair of radial flanges 50 and 52 extending radially from opposite ends thereof. The flange 52 is thicker than the flange 50 and has a pair of projecting portions 54 disposed in depending relation at the periphery thereof. Formed in the projecting portions 54 is a pair of diametrically opposed grooves 56 which also extend through the periphery of the associated flange 52.

The electromagnetic coil assembly 46 also includes a coil of wire 58 wound around the bobbin core 48 between the flanges 50 and 52 with one end portion thereof extending within one of the grooves 56 and the other end portion thereof extending within the other groove 56. Each of the projecting portions 54 is provided with a central bore extending therein into which is pressed or bored a metallic pin 60. The ends of the coil of wire extending from the grooves 56 are wrapped around the pins 60 and suitably soldered thereto so that the pins 60 can extend into the circuit board assembly 14 to be soldered therein within the circuitry provided.

It will be noted that the electromagnetic coil assembly 46 is adapted to be disposed within the portion of the central space 32 of the rigid annular structure 18 adjacent the base plate 30 and the latter is suitably apertured to receive the projecting portions 54 therethrough so that the pins 60 are in the same position as the legs 36 for aiding in the mounting of the acoustic transducer 12 on the circuit board assembly 16 as by solder or the like, as well as to connect the coil of wire 58 within the circuit thereof.

The circuit of the circuit board assembly 14 may be of any suitable configuration. It may be quite elaborate so as to include a microprocessor which can be programmed to energize the coil when desired. Examples of circuits which may be utilized are disclosed in U.S. Pat. Nos. 4,286,257 and 4,183,278, the disclosures of which are hereby incorporated by reference into the present specification. The circuitry may also provide for the characteristic of the electrical signal which energizes the coil of wire 58 to provide the desired chime. Alternatively, the circuit board may be simply a holding circuit board with the intelligence being disposed exteriorly thereof. As shown, the circuit board assembly includes a circuit board 62 having fixed thereto an electrical connector 64 which is electrically connected with the circuit on the circuit board 62 and adapted to interengage with a cooperating electrical connector (not shown) to interconnect the circuit board 62 with the electrical circuit of the automotive vehicle including the storage battery thereof. The electrical connector 64 also is configured so as to mountingly cooperate with the housing assembly 16.

The housing assembly 16 may be of any suitable construction and, as shown, constitutes a one-piece molding of suitable plastic material. The molding provides a bottom wall 66, a pair of side walls 68 extending upwardly therefrom, a rear wall 70 extending upwardly from the bottom wall 66 between one of the ends of the side walls 68 and a front wall 72 extending upwardly between the opposite ends of the side walls 68 from the bottom wall 66. The housing also includes a top wall 74 having a living hinge 76 formed integrally at one end thereof which hinge 76 is also integral with the upper end of the rear wall 70. Preferably, the top wall 74 includes a central rib 76 and short side wall sections 78 extending in the direction of the rib 76 from opposite side edges thereof for cooperating with the side walls 68. A front flange or wall section 80 extends from the front edge of the top wall 74 for cooperation with the front wall 72.

The side walls 68 and associated portions of the bottom wall 66 include mounting feet 82 depending from the bottom wall 66 and interior ledges 84 integral with the side walls 68 extending above the bottom wall 66. The ledges 84 serve to position and receive the circuit board 62 as it is moved downwardly within the side walls 68 and front and rear walls 72 and 70.

As best shown in FIG. 3, the electrical connector 64 cooperates with the front wall 72 to retain the circuit board assembly 14 in fixed relation within the housing assembly 16 with the electrical connector 64 extending exterior thereof. It will be noted that the front wall section 80 and side wall sections 78 of the top wall 74 cooperate with the front wall 72 and side walls 68 respectively to maintain the circuit board assembly 14 in operative position when the top wall 74 is closed. In this regard, it will be noted that the top wall 74 is provided with openings 86 which serve to communicate the interior of the housing with the surrounding atmosphere.

Figure 8:
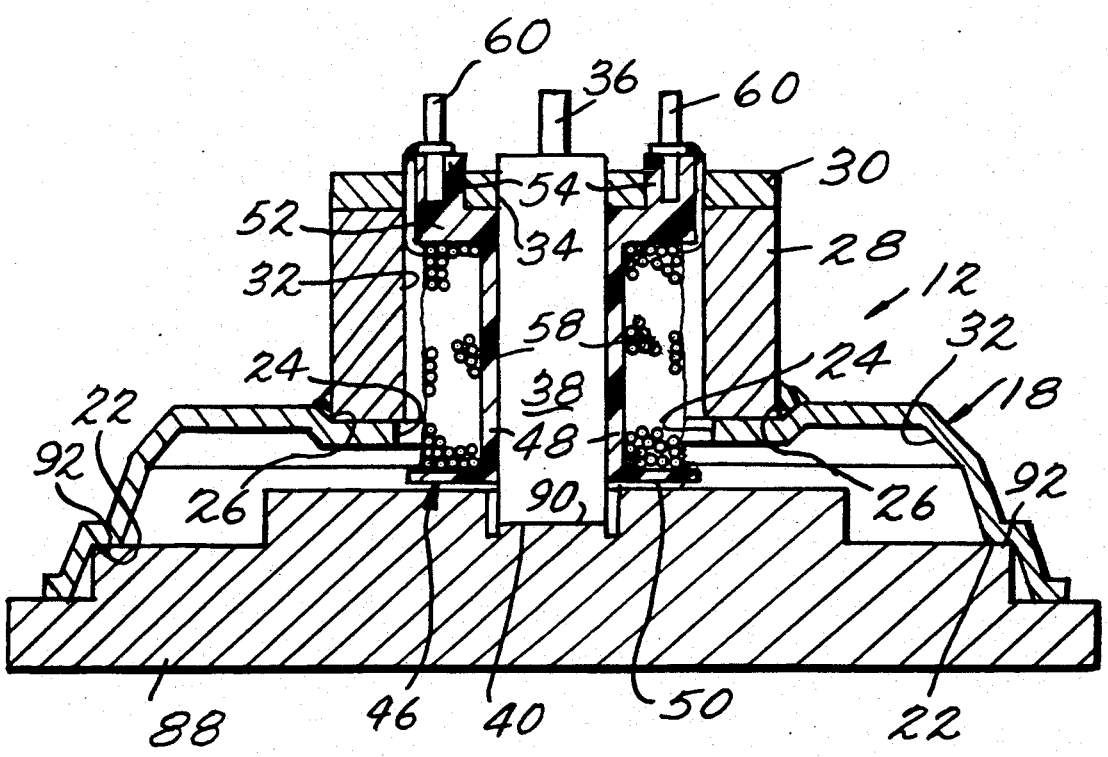
FIG. 8 is a vertical sectional view of the acoustic transducer in an assembly stage in operative relation with an assembly fixture.

Referring now more particularly to FIG. 8, this figure illustrates a stage in the preferred method of constructing the acoustic transducer 12. As previously indicated, the rigid annular structure 18 is assembled by suitably bonding the sheet metal member 20, ring magnet 28 and base plate 30 together in the relationship previously described and shown. In the preferred method of manufacture, the pole piece 38 is then inserted through the axial surface 34 of the base plate 30 and then the electromagnetic coil assembly 46 is mounted in surrounding relation with the pole piece 38 within the central space 32 so that the projecting portions 54 extend through the openings in the base plate 30 permitting the pins 60 to extend exteriorly of the rigid annular structure 18.

With the parts assembled in the condition stated, the assembly is then moved into cooperating relation with an assembly fixture, generally indicated at 88 in FIG. 8. The assembly fixture 88 includes two essential locating surfaces for the assembly. First, a central surface 90 for engaging the end 40 of the pole piece 38 and an annular surface 92 for engaging the diaphragm engaging surface 22. The transducer components assembled in the manner previously described are mounted in inverted cooperating relation to the assembly fixture 88 in such a way that the diaphragm-engaging annular surface 22 is moved into engagement with the surface 92 of the assembly fixture 88 so as to establish a predetermined axial position of the rigid annular structure 18 with respect to the assembly fixture 88. Next, the pole piece 38 which is adjustably slidably mounted within the cylindrical surface 34 of the base plate 30 is moved axially so that its end surface 40 engages the surface 90 of the assembly fixture 88. The remaining configuration of the assembly fixture 88 is of non-critical configuration so long as the remaining surfaces are disposed out of contact with any of the other surfaces of the transducer assembly.

In this regard, it will be noted that the electromagnetic coil assembly 46 is capable of a limited amount of axial movement when the transducer assembly is mounted in cooperating relation with the assembly fixture 88. The assembly fixture 88 by virtue of the two surfaces 90 and 92 serves to accurately locate the axial position of the end surface 40 of the pole piece 38 with respect to the diaphragm-engaging annular surface 22 of the rigid annular structure 18. It will be noted that a portion of the pole piece 38 may extend outwardly of the cylindrical surface 34 of the base plate 30. Thus, when the cooperating relationship has been established, it is a simple matter for the operator to place a bead of epoxy or other suitable adhesive in the joint between the exterior surface of the base plate 30 surrounding the opening 34 and the outwardly projecting portion of the pole piece 38. This bonding of the pole piece 38 with the base plate 30 serves to set the axial relationship of the pole piece surface 40 with the diaphragm-engaging surface 22 of the rigid annular structure 18. Next, the operator removes the transducer assembly from the assembly fixture 68 and inverts the transducer assembly so as to expose the central space 32 within the rigid annular structure 18 which is not taken up by the electromagnetic coil assembly 46. Finally, the operator pours a potting compound or liquid adhesive (epoxy) into the central space 32 and effects curing thereof so as to rigidify both the electromagnetic coil assembly 46 and the pole piece 38 within the rigid annular structure 18.

It will be understood that the mounting of the electromagnetic assembly 46 into the assembly before engaging the assembly with the fixture 88 is preferred because of the added stability to the positioning of the pole piece 38 which the electromagnetic coil assembly 46 adds. However, the electromagnetic coil assembly 46 may be added after the pole piece has been exteriorly bonded as aforesaid The last step of the assembly is simply to position the diaphragm 42 so that its marginal edge portion engages the diaphragm-engaging surface 22. The magnetic attraction of the ring magnet 28 through the sheet metal member 20 serves to magnetically attract and maintain the diaphragm 42 in an operative position in engaged relation with the diaphragm-engaging surface 22. This retention constitutes the sole means for retaining the diaphragm 42 in its operative position and ensures that the gap between the central armature portion of the diaphragm 42 and the end surface 40 of the pole piece 38 is exactly in accordance with the dimension desired as determined by the assembly fixture 88. The assembly method of the present invention thus accurately maintains the gap so long as the diaphragm 42 is perfectly flat and planar, a condition which can be readily maintained.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A tone generator suitable for automotive vehicle use comprising housing means defining an interior space open to the atmosphere, circuit board means mounted within said housing means, and transducer means carried by said circuit board means within said housing means, said transducer means comprising:

a rigid structure of magnetic material annular about a central axis, said rigid annular structure having an axially outwardly facing annular diaphragm engaging surface formed in one axial end portion thereof, an interior peripheral surface extending axially therefrom defining a central space terminating in a radially inwardly directed opposite end wall having a central pole piece engaging interior axially extending surface therein communicating with said central space, a diaphragm of magnetic material having an outer annular marginal edge portion engaging said diaphragm engaging surface and a central portion providing armature means, said rigid annular structure including a permanent magnet operable to constantly magnetically attract the marginal edge portion of said diaphragm into engagement with the diaphragm engaging surface of the rigid annular structure, said diaphragm and armature means being free of engagement other than the engagement of the outer annular marginal edge portion thereof with said annular diaphragm engaging surface so that the aforesaid magnetic attraction constitutes the sole means of constantly retaining said diaphragm in an operative position with respect to said rigid annular structure enclosing the associate axial end of said central space, a pole piece extending within said central space in alignment with said axis, means for fixedly securing said pole piece with respect to said rigid structure with an end portion of said pole piece engaged in a predetermined position of axial adjustment along said pole piece engaging surface so that a remote end surface of said pole piece is disposed within said central space a predetermined gap distance from the central portion of said diaphragm, electromagnetic coil means mounted within said central space in surrounding relation to said pole piece and in axially spaced relation with said diaphragm so as to leave a portion of the central space enclosed by said diaphragm operatively dynamically acoustically sealed by the engagement of the outer marginal peripheral edge portion of the diaphragm with said diaphragm engaging surface but statically communicated with the interior space within said housing means, and means for mounting said rigid annular structure on said circuit board means and for electrically connecting said electromagnetic coil means with said circuit board means so as to be electrically energized by the operation of said circuit board means to thereby impart vibrations to said diaphragm which dynamically varies the conditions within the closed portion of the central space and creates within the interior space within said housing means a desired tone sequence which is audible to a person within the atmospheric environment of the automotive vehicle.

2. A tone generator as defined in claim 1 wherein said one axial end portion of said rigid annular structure is provided by an end portion of an annular sheet metal member of generally bowl-shaped configuration including a bottom wall having a central opening therein and a peripheral wall having an outer annular rim defining said axially outwardly facing annular diaphragm-engaging surface.

3. A tone generator as defined in claim 2 wherein said bottom wall is recessed at the central opening therein, the permanent magnet included in said rigid annular structure comprising a ring magnet having one end fixed within the recess in said bottom wall and extending therefrom so as to define with the central opening in said bottom wall a portion of the interior peripheral surface defining said central space.

4. A tone generator as defined in claim 3 wherein the opposite end wall of said rigid annular structure is provided by a base plate fixed in abutting relation with an opposite end of said ring magnet.

5. A tone generator as defined in claim 4 wherein said electromagnetic coil means includes a bobbin of electrically insulating plastic material, said bobbin including a cylindrical core having opposite ends with annular flanges extending radially outwardly therefrom and a coil of wire wound around said core between said flanges.

6. A tone generator as defined in claim 5 wherein one of said bobbin flanges has a pair of spaced depending portions thereon, said one bobbin flange also having a pair of spaced peripheral grooves formed therein which extend peripherally along said pair of depending portions for receiving opposite ends of the coil of wire therein, each of said depending portions having a metal pin embedded therein and extending in depending relation therefrom to which an associated wire end is soldered, said pins being soldered to said circuit board means.

7. A tone generator as defined in claim 6 wherein said base plate is apertured to receive said depending portions therethrough.

8. A tone generator as defined in claim 7 wherein said base plate is formed with integral diametrically opposed legs bent into depending relation with respect thereto and solder means for fixedly securing said legs and said pins with said circuit board means to mount said acoustic transducer thereon.

9. A tone generator as defined in claim 8 wherein said armature means comprises a disk of metal bonded to the exterior of the central portion of said diaphragm.

10. A tone generator as defined in claim 1 wherein said electromagnetic coil means includes a bobbin of electrically insulating plastic material, said bobbin including a cylindrical core having opposite ends with annular flanges extending radially outwardly therefrom and a coil of wire wound around said core between said flanges.

11. A tone generator as defined in claim 10 wherein one of said bobbin flanges has a pair of spaced depending portions thereon, said one bobbin flange also having a pair of spaced peripheral grooves formed therein which extend peripherally along said pair of depending portions for receiving opposite ends of the coil of wire therein, each of said depending portions having a metal pin embedded therein and extending in depending relation therefrom to which an associated wire end is soldered.

12. A tone generator as defined in claim 1 wherein said armature means comprises a disk of metal bonded to the exterior of the central portion of said diaphragm.

13. A transducer comprising:

a rigid structure of magnetic material annular about a central axis, said rigid annular structure having an axially outwardly facing annular diaphragm engaging surface formed in one axial end portion thereof, an interior peripheral surface extending axially therefrom defining a central space terminating in a radially inwardly directed opposite end wall having a central pole piece engaging interior axially extending surface therein communicating with said central space, a diaphragm of magnetic material having an outer annular marginal edge portion engaging said diaphragm engaging surface and a central portion providing armature means, said rigid annular structure including a permanent magnet operable to constantly magnetically attract the marginal edge portion of said diaphragm into engagement with the diaphragm engaging surface of said rigid annular structure, said diaphragm and armature means being free of engagement other than the engagement of the outer annular marginal edge portion thereof with said annular diaphragm engaging surface so that the aforesaid magnetic attraction constitutes the sole means of constantly retaining said diaphragm in an operative position with respect to said rigid annular structure enclosing the associate axial end of said central space, a pole piece extending within said central space in alignment with said axis, means for fixedly securing said pole piece with respect to said rigid structure with an end portion of said pole piece engaged in a predetermined position of axial adjustment along said pole piece engaging surface so that a remote end surface of said pole piece is disposed within said central space a predetermined gap distance from the central portion of said diaphragm, and electromagnetic coil means mounted within said central space in surrounding relation to said pole piece and in axially spaced relation with said diaphragm so as to leave a portion of the central space enclosed by said diaphragm operatively dynamically acoustically sealed by the engagement of the outer marginal peripheral edge portion of the diaphragm with said diaphragm engaging surface but statically communicated with the interior space within said housing means.

14. A transducer as defined in claim 13 wherein said one axial end portion of said rigid annular structure is provided by an end portion of an annular sheet metal member of generally bowl-shaped configuration including a bottom wall having a central opening therein and a peripheral wall having an outer annular rim defining said axially outwardly facing annular diaphragm-engaging surface.

15. A transducer as defined in claim 14 wherein said bottom wall is recessed at the central opening therein, the permanent magnet included in said rigid annular structure comprising a ring magnet having one end fixed within the recess in said bottom wall and extending therefrom so as to define with the central opening in said bottom wall a portion of the interior peripheral surface defining said central space.

16. A transducer as defined in claim 15 wherein the opposite end wall of said rigid annular structure is provided by a base plate fixed in abutting relation with an opposite end of said ring magnet.

17. A transducer as defined in claim 16 wherein said electromagnetic coil means includes a bobbin of electrically insulating plastic material, said bobbin including a cylindrical core having opposite ends with annular flanges extending radially outwardly therefrom and a coil of wire wound around said core between said flanges.

18. A transducer as defined in claim 17 wherein one of said bobbin flanges has a pair of spaced depending portions thereon, said one bobbin flange also having a pair of spaced peripheral grooves formed therein which extend peripherally along said pair of depending portions for receiving opposite ends of the coil of wire therein, each of said depending portions having a metal pin embedded therein and extending in depending relation therefrom to which an associated wire end is soldered.

19. A transducer as defined in claim 13 wherein said electromagnetic coil means includes a bobbin of electrically insulating plastic material, said bobbin including a cylindrical core having opposite ends with annular flanges extending radially outwardly therefrom and a coil of wire wound around said core between said flanges.

20. A transducer as defined in claim 19 wherein one of said bobbin flanges has a pair of spaced depending portions thereon, said one bobbin flange also having a pair of spaced peripheral grooves formed therein which extend peripherally along said pair of depending portions for receiving opposite ends of the coil of wire therein, each of said depending portions having a metal pin embedded therein and extending in depending relation therefrom to which an associated wire end is soldered.

21. A transducer as defined in claim 13 wherein said armature means comprises a disk of metal bonded to the exterior of the central portion of said diaphragm.

22. A method of assembling transducer components with the use of an assembly fixture in which the transducer components include a rigid annular structure including a permanent magnet, the rigid annular structure having an axially outwardly facing annular diaphragm engaging surface formed in one axial end portion thereof, an interior peripheral surface extending axially therefrom defining a central space terminating in a radially inwardly directed opposite end wall having a central pole piece engaging interior axially extending surface therein communicating with said central space, a diaphragm of magnetic material having an outer annular marginal edge portion, a pole piece having an end portion engageable with the pole piece engaging surface of the rigid annular structure for axial movement with respect thereto and a remote end surface, and an electromagnetic coil assembly, and the assembly fixture has an outer annular surface shaped to be engaged by the diaphragm engaging surface of the rigid annular structure and a central surface spaced a predetermined axial distance from the outer annular surface shaped to be engaged by the end surface of the pole piece, said method comprising the steps of engaging (1) the diaphragm surface of the rigid annular structure and (2) the end surface of the pole piece with (1) the outer annular surface and (2) central surface respectively of the assembly fixture while the end portion of the pole piece is engaged with the pole piece engaging surface of the rigid annular structure so as to establish said predetermined axial space between the diaphragm engaging surface of the rigid annular structure and the end surface of the pole piece, securing the pole piece and rigid annular structure together against relative axial movement with respect to one another and the electromagnetic coil assembly in aligned relation thereto within the central space of the rigid annular structure and in surrounding relation to the pole piece, and mounting the diaphragm in assembled relation within the transducer solely by engaging the marginal edge portion thereof with the diaphragm engaging surface of the rigid annular structure to be retained therein solely by the magnetic attraction of the permanent magnet of the rigid annular structure.

23. A method as defined in claim 22 wherein the electromagnetic coil assembly is initially disposed in assembled relation within the central space of the rigid annular structure and in surrounding relation with said pole piece prior to the engagement of the diaphragm engaging surface of the rigid annular structure and end surface of the pole piece with the respective surfaces of the assembly fixture.

24. A method as defined in claim 23 wherein the pole piece and rigid annular structure are secured together by adhesive applied to exterior abutting surfaces thereof while in an inverted relation with the diaphragm engaging surface of the rigid annular structure and the end surface of the pole piece in engagement with the respective surfaces of the assembly fixture.

25. A method as defined in claim 24 wherein the securement of the electromagnetic coil assembly in the assembled relation within the central space of the rigid annular structure and in surrounding relation with the pole piece is accomplished by pouring a liquid adhesive within the central space while the rigid annular structure and pole piece are in a non-inverted position and rigidify the liquid adhesive.

* * * * *